US005593374A

United States Patent [19]

Gvoich

[11] Patent Number: 5,593,374

[45] Date of Patent: Jan. 14, 1997

[54] EXERCISE DEVICE FOR CONDITIONING THE MUSCLES OF THE GLUTEAL REGION

[75] Inventor: Ned Gvoich, Beamsville, Canada

[73] Assignee: Kor-One, Ltd., Scottsdale, Ariz.

[21] Appl. No.: 504,127

[22] Filed: Jul. 19, 1995

[51] Int. Cl.[6] ..... A63B 21/02

[52] U.S. Cl. ..... 482/123; 482/129; 482/124; 482/79; 482/907

[58] Field of Search ..... 482/121, 122, 482/123, 129, 79, 907, 142, 131, 124; 606/241; 5/648, 650

[56] References Cited

U.S. PATENT DOCUMENTS

| | | | |
|---|---|---|---|
| 1,336,910 | 4/1920 | MacFadden | 482/131 |
| 2,340,666 | 2/1944 | Johanson | 482/79 |
| 3,117,782 | 1/1964 | Johnston . | |
| 3,428,312 | 2/1969 | Machen . | |
| 4,403,773 | 9/1983 | Swann . | |
| 4,411,426 | 10/1983 | McCoy . | |
| 5,100,129 | 3/1992 | Porter et al. | 482/129 |
| 5,342,269 | 8/1994 | Huang . | |
| 5,346,447 | 9/1994 | Stearns . | |
| 5,354,251 | 10/1994 | Sleamaker . | |

*Primary Examiner*—Lynne A. Reichard
*Attorney, Agent, or Firm*—O'Connor Cavanagh

[57] ABSTRACT

A device for exercising the muscles of the gluteal region comprising a rigid frame formed as an elongated bar. A hip support is rotatably attached to the middle of the frame and a back support is attached to the hip support. The device further comprises a bootie having elastic resistance members connected to the toe and heel portions of the bootie.

7 Claims, 2 Drawing Sheets

EXERCISE DEVICE FOR CONDITIONING THE MUSCLES OF THE GLUTEAL REGION

BACKGROUND OF THE INVENTION

Field of Invention

This invention relates to an exercise device for exercising the major muscles comprising the gluteal region, while providing a full range of motion to assure effective toning and strengthening of the muscles of that region. It is well known in the fitness industry that exercises that are specific to particular muscles and/or to portions of the those muscles, best suited to optimally strengthen and tone the principal muscles in the gluteal region.

Ordinarily, movements of non-weight bearing joints are described by the movement of the distal part in relation to the proximal part e.g. the knee in relation to the hip or the foot in relation to the knee. The hip joint is functionally unique since in weight bearing postures, i.e., standing or walking, the foot is planted on the floor. When the foot is planted on the floor the pelvic ischium bones may move on the femur, rather than the femur moving on the pelvis such as occurs when bending forward at the waist to pick something off the floor. This movement is controlled by the hip joint muscles. When one comes back up from the bent position, the hip muscles initiate and control the movement of the trunk back to the erect position. Therefore, strong buttock muscles provide a safety feature to the functional movements of the spine. Weak hip muscles, and in particular the buttock muscles, cause excessive strain on the lower back muscles by requiring the lower back muscles to bring the trunk up from the forward bent position, or in even more common movements, such as when raising the body up and out of a seated posture.

Muscles work in groups to move a body part. These groups are called the synergist muscles, the agonist muscles and the antagonist muscles. The muscles relevant to exercising and toning the gluteal region are the synergist and agonist muscles of the hip joint.

The synergist muscles are generally the small muscles of the joint that serve to hold the joint in place and thus provide an anchoring of the joint about which a movement can occur. In the hip joint these muscles are the: gemellus superior; gemellus inferior, quadratus femoris, obturator externus, obturator internus and piriformis muscles. The synergist muscles are best exercised with the use of free weights since these muscles are called into action to maintain the hip joint in a particular plane of motion. Free weight exercising is more desirable than machines which operate on a track, because track machines do not require the hip synergist muscles to stabilize the joint in a particular plane of motion while the exercise is performed.

The agonist muscles are the prime mover muscles that are specifically addressed with exercise. In the hip joint, these muscles are the gluteus minimis, gluteus medius and gluteus maximus muscles. These are commonly referred to as the buttocks. The gluteus maximus and the gluteus medius muscles are twisted counterclockwise on themselves so as to attach to the femur of the hip bone and cause extension of the hip and external rotation of the hip simultaneously. The gluteus medius is attached to the front portion of the hip and acts to extend and internally rotate the hip. An exercise device must take these movements patterns into account to effectively exercise all three muscle. Most people are only familiar with the gluteus maximus muscle, yet the overall definition of the buttock area involves the exercising of all three muscles.

The ranges of motion of the hip joint are:

Flexion (antagonist movement) of the hip joint is movement of the knee forwardly toward the fixed trunk or of the pelvis forwardly towards the fixed thighs as in bending forwardly at the trunk to pick something off of the floor. The range of motion from the leg straight position, with the knee bent to slacken the rectus femoris muscle, (zero point) is about 125 degrees.

Extension (agonist movement and synergist movement) of the hip joint is movement of the knee backwardly away from the trunk or of the pelvis backwardly as in returning the trunk from the forward bent position to the upright position. The range of motion from the leg straight position (zero point) is about 10 degrees. Therefore the total range of hip joint flexion and extension movement is about 135 degrees.

Adduction (antagonist movement) of the hip joint is movement of the knee downwardly toward the floor in the side-lying position or of the pelvis sideways and upwardly toward the rib cage. The Adductor muscles are the antagonists to gluteal exercise movements. The range of motion from the leg straight position (zero point) is about 10 degrees.

Abduction (agonist movement and synergist movement) of the hip joint is movement of the knee upwardly from the floor in the side-lying position or of the pelvis sideways and downwardly toward the hip joint. The pelvic movement occurs if the load to hip joint exceeds the strength of the back muscles which control the lateral pelvic movement. Therefore, proper positioning for training the gluteal muscles also helps train the lateral back muscles. The range of motion from the leg straight position (zero point) is about 45 degrees. Therefore the total range of hip joint adduction and abduction movement is about 55 degrees.

Medial Rotation (antagonist movement) of the hip joint is movement of the thigh inwardly or of the pelvis rotating clockwise on one femur at a time such as occurs when the right foot is planted on the floor and the trunk is toward the right hip (the "twist" dance move). The range of motion from the leg straight position (zero point) is about 60 degrees.

Lateral Rotation (agonist movement and synergist movement) of the hip joint is movement of the thigh outwardly upwardly from the floor in the side-lying position or of the pelvis rotating counter-clockwise on one femur at a time such as occurs when the right foot is planted on the floor and the trunk is turned toward the left hip (the "twist" dance move). The range of motion from the leg straight position (zero point) is about 90 degrees. Therefore the total range of hip joint lateral and medial rotation is about 150 degrees.

Thus, to effectively exercise the agonist and synergist muscles of the hip, the motions of extension, abduction and lateral rotation must be included in the exercise motion. Conventionally these muscles are exercised separately. Since these muscles act in a coordinated fashion to provide functional movements to the body, and in particular to prevent displacement of stress to the spine, it is desirable to exercise all three muscles in a functional pattern throughout the full range of hip joint motion. The conventional buttock exercise has been, up to now, the donkey kick back technique. This technique is performed with the exerciser in the quadruped stance (on all fours) and the leg to be exercised is bent at the knee then raised straight upwardly in a manner so as to push the sole of the foot up towards the ceiling in a slight arcing motion. In order to more effectively isolate and exercise all three of the gluteal muscles the exercise is also performed by bringing the knee inwardly towards the opposite hip and then upwardly and then outwardly towards the same hip and then upwardly. Some machines, incorporate a track on which the motion is restricted to the straight upward motion thus exercising specifically only the gluteus minimum portion of the gluteal muscle group.

This "donkey kick" exercise motion is not an effective functional exercise, i.e., exercise which supports and promotes functional body movement and thereby strong, coordinated action of the body which effectively serves as a prophylactic against bodily injury. The problem arises because this exercise motion is extremely hazardous to the anatomy of the pelvis and lower back and may cause, if done too quickly or in a jerking motion, excessive strain to the lower back and pelvic joints. Though one may substantially prevent injury from occurring by performing the motion with correct tempo and technique, there remains an increase in potential for injury when the exercise is performed to the point of muscle fatigue. This is a double edged sword, for it is imperative that a muscle, or muscle groups be challenged to fatigue in order to get the desired results. Adding resistance to the leg while performing this exercise, such as an ankle weight, or, in the case of the gym machines, a weight stack, causes the exerciser to tend to perform the exercise with jerky movements in order to initially overcome the resistance and thus negate any safety of the exercise provided by proper technique or form.

Furthermore, in conventional free hand exercises and those involving the use of weights, the back is kept either in a vertical or horizontal position. Exercises in these positions tend to cause the back to arch which can result in discomfort and fatigue of the back as well as potential injury to the back as the lower back is rotated or flexed in an unsafe manner. The pelvic joint termed the sacroiliac joint must be protected when exercising the buttock muscle groups. As previously mentioned the conventional "donkey kick" wherein the exerciser is on all fours and the hip is extended, causes the pelvic bones to lock at the full extent of flexion range of motion of the sacroiliac joints and thus the lower back is strained by excessive extension or swayed back movement especially when complicated by the weight of the abdomen which assists the swaying motion of the lower spine. Again, this can be avoided if the hip is not excessively extended, however, a compromise of the hip buttock exercise is given up by avoiding full range of motion extension of the hip joint. Furthermore, a common cause of low back pain is sacroiliac joint fixation. The "donkey kick" exercise method may result in strain of the sacroiliac joints and lead to the onset of low back pain.

For maximum benefit exercises should be performed in the optimal safe posture and in the correct planes of motion so as to effectively exercise both the muscles that are desired to be targeted, in this case the gluteal muscles, and at the same time strengthen the synergistic muscles which hold the joint in optimum position for body function. The exercise should also provide a body position which reduces substantially any risk for displacement of the load and thereby strain to another anatomical area, such as the pelvic joints or the joints of the lower back.

In order to train for strength, the exerciser must not allow a muscle or muscle groups to adapt to the resistance load. This is accomplished by progressively increasing the resistance or load to the muscle or muscle groups or alternatively by positioning the load at the end or along various lengths of the body lever, in this case the leg. Various resistance-type exercise devices for exercising muscles of the gluteal region are known. However, it has been found that when a person undertakes a program of conditioning the muscles of the gluteal region by systematic use of such a device, that person often soon abandons the program because the resistance is so great as to allow performing only a few repetitions before fatigue sets in, or so small that the muscles are not adequately stressed regardless of how many repetitions are done.

Even if the resistance is initially in an appropriate range for a users muscular strength, he or she may find as the muscles become stronger through exercise, that a conditioning plateau is reached where the set resistance is insufficient to provide further strengthening, thereby necessitating a need for a means to progressively increase or vary the resistance. As is well known, the preferred method for strengthening muscles is exercise using progressively increasing resistance because this places increasing demand on muscles and prevents them from accommodating them to a specific force. Thus, to enable a resistance-type device to be used effectively by individuals having different strength and to enable an individual who progresses through an exercise program to remain challenged as his or her strength increases, there is also a need for an exercise device for the gluteal region that not only meets the above-stated criteria but also one in which the resistance can be conveniently increased or decreased.

The present invention provides a freedom of range of motion, thus requiring the exerciser to stabilize the joint with the synergistic muscles in order to accomplish the exercise movement involving abduction, external rotation and extension of the hip joint, since the plane of motion of the hip joint changes from the start point and throughout the exercise motion to the finish point of the exercise. In addition, the present invention performs the exercise in the side-lying posture. This has the benefit of preventing strain of the sacroiliac joints while unloading the lower spine from the weight of the abdomen to effectively permit a safe full range of motion of the hip joint into extension.

The present inventions includes, in a preferred embodiment, elastic cords that can be adjusted to increase the applied resistance to provide for progressive and variable resistance, a necessary feature of any serious strength training machine. Furthermore, since the attachment to the leg is at the foot, which is the end of the leg lever, the resistance is always at an optimum position for maximum resistance to the movement. A further advantage gained from the position of the resistance anchor at the foot is the incorporation of ankle and knee stabilizing muscles thus ensuring an overall leg strengthening and toning. In particular the muscles forming the peroneal muscle group on the outside of the lower leg are commonly weak in individuals which is a common cause of recurring ankle sprains. Also, the present invention exercises the tensor fascia latae muscle. This muscle is a smooth flat muscle located on the outside of the thigh and gives a properly toned thigh it's characteristic sleek shape.

OBJECTS OF THE INVENTION

Accordingly, it is an object of the invention to provide a device which permits exercise incorporating a combination of the three primary motions (abduction, lateral rotation and extension) associated with the agonist muscles of the hip joint.

A further object of the invention is to provide a device for exercising the muscles of the gluteal region whose resistance can be easily adjusted so as to accommodate users of different strengths, and also provide a means of progressive resistance exercise for any individual user.

Another object of the invention is to provide a device which is light-weight and compact so as to accommodate packing and carrying.

One more object of the invention is to provide a system that is relatively simple and inexpensive to manufacture, yet reliable.

A further object of the invention is to provide a device to activate the synergistic muscle groups of the hip joint.

A still further object of the invention is to provide a device to isolate the desired muscles and train them through a functional range of motion.

Another object of the invention is to provide safety by correctly positioning the body and thus allow a maximum range of motion for the desired targeted muscle while not stressing other joints that may be positioned in a weak posture, e.g., the sacroiliac joints of the pelvis and the joints and discs of the spine.

A further object of the invention is to simultaneously train the joint stabilizers of the joints immediately above and below the joint being exercised.

A still further object of the invention is to strengthening the pelvic girdle and hip joints will provide overall improved performance.

One other object of the invention is to target train or spot train the muscles in combination with cross training exercise techniques for maximum endurance.

SUMMARY OF THE INVENTION

The present invention overcomes inadequacies of conventional exercise techniques and devices for the muscles of the gluteal region by providing an adjustable, light-weight, compact and easy to use variable resistance-type device for exercising the muscles of the gluteal region and which enables a user to easily and safely assume and maintain the primary motions of the buttock muscles during an exercise routine.

Accordingly, in general terms the device includes a rigid frame which is a long thin bar, the ends of which have been angled in the upward direction. Attached to this frame is a pad on which the user rests his or her hip. Connected to this pad is an extension which supports the back and maintains the spine in a straight line. This extension can be moved from one side of the hip pad to the other to allow exercise of both the right and left buttocks. Attached to each end of the rigid frame are elastic means such as rubberbands or springs. The other ends of these elastic means are connected to a bootie which is placed over the foot. One elastic means connects to the back of the bootie and the other elastic means connects to the front of the bootie near the toes of the foot.

The users inserts his or her foot into the bootie and lays across the hip pad with the side of the body which is not to be exercised laying on the floor. The user then draws the knee up towards the abdomen countering resistance of the bands. The user extends the foot in a arc motion such that as the leg becomes fully extended the foot moves from in front of the body to behind the body, describing an arc, the apex of which is above the sagittal plane and the ends of which are in contact with or near to the sagittal plane.

The device may be further modified for additional portability by providing a joint along the rigid frame so that it can be broken down. Also the upward bend in the bar may be replaced by a detachable vertical members. The elastic bands can be varied in resistance by either adding additional bands or using bands of increased modulus.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which.

DESCRIPTION OF THE PREFERRED EMBODIMENTS

Figure 1:
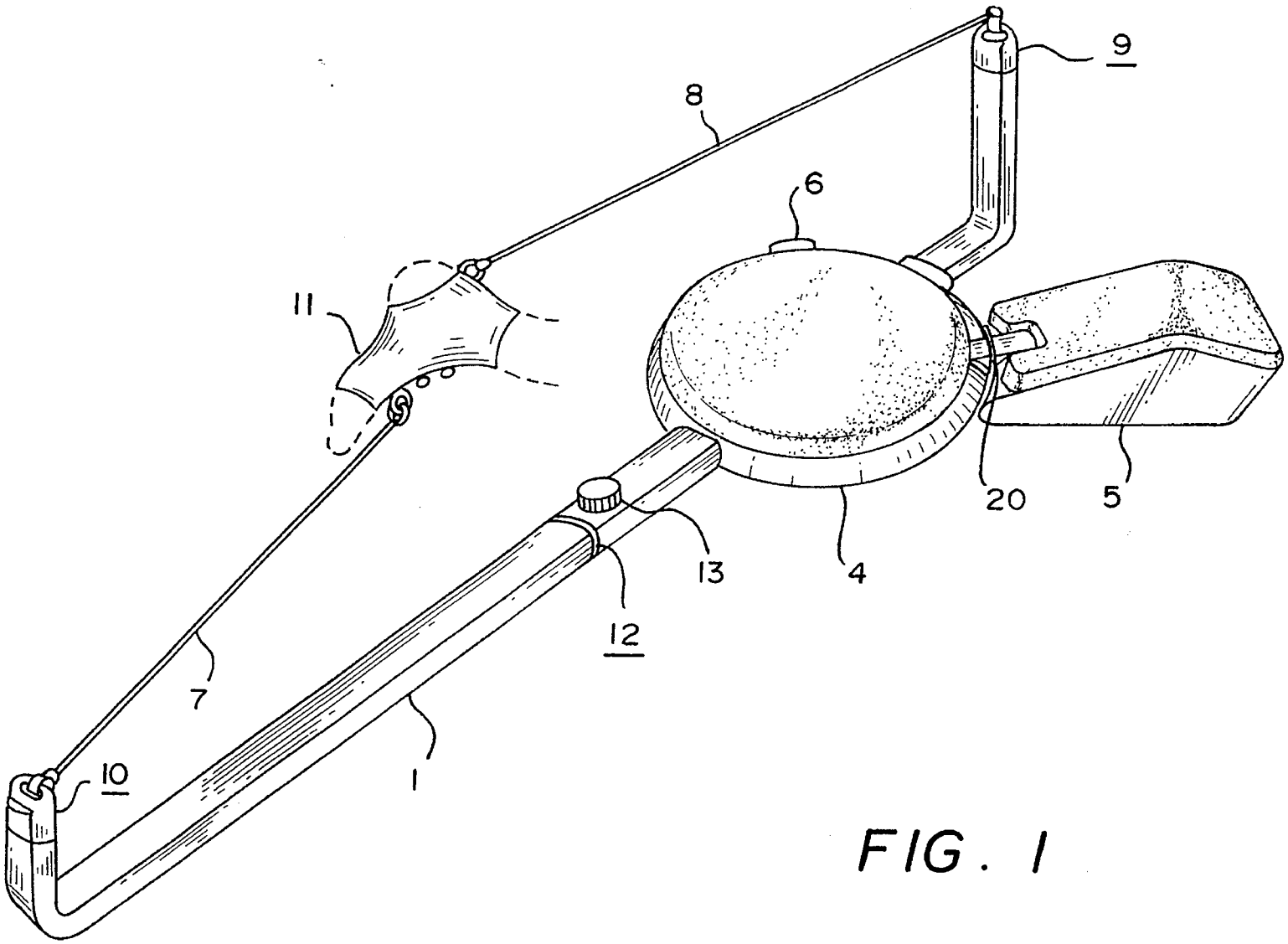
FIG. 1 is a perspective view of a first preferred embodiment.

The preferred embodiment of the exercise device for the muscles of the gluteal region of the present invention will be described with reference to FIGS. 1–3. As shown in FIG. 1, an exercise device for the muscles of the gluteal region includes a rigid frame 1 of a predetermined length sufficient to permit the full range motion required to exercise the gluteal muscles. The rigid frame 1 is preferably rectangular in cross-section, but can be made using any other cross-sectional configurations so long as the frame remains in a stable orientation during use. The frame is also preferably fabricated from a rigid metal material such as steel, although virtually any other rigid material, such as wood, plastic, or aluminum may be used.

Each end, 9 and 10, of the rigid frame 1 is bent in an upward direction at an angle sufficient to raise the ends above the surface of the floor to allow the exercise to be performed. In the preferred embodiment, the front end 10 of the frame 1 is raised approximately 5 inches above the floor. This ensures that the elastic means 7 not hit the support leg, i.e., the leg not being exercised. The rear end 9 of the frame 1 is raised approximately 9 inches above the floor. This ensures that elastic means 8 does not contact the users buttocks during the exercise activity. The precise height of the frame ends off the floor may be selected as a matter of design choice, provided the goal of avoiding interference with the elastic means by the users body is met.

A hip pad 4 is rigidly attached to the rigid frame 1 at a point along the length of the frame which will allow the most effective exercise of the gluteal muscles. The hip pad 4 is a broad planar surface sufficiently large enough to accommodate and support the hip portion of a users body, but not so large as to interfere with the operation of the back support 5.

The back support 5 is attached to the hip support in a position to provide support for the spine as the user rests on his or her side with their hip on the pad their shoulder against the floor. Normally, as a user rests on his or her side, the spine will "droop" causing discomfort, and possibly injury to the back during exercise. The back support 5 is sized to provide support sufficient to prevent this droop, and may be padded for additional comfort. Likewise, the back support 5 may be adjustable in height so as to accommodate a wider range of users and body types. The back support 5 may also be permanently affixed to the hip support, thus requiring two such back supports. The back support may be affixed by means of a temporary joint 20 such that it may be removed and transferred to the other side of the hip support where it is attached to a second temporary joint 6. In the preferred embodiment, the back support is positioned at approximately a 30° angle from the longitudinal axis of the frame in order to provide the greatest range of motion for exercises related to the elastic means 8. The angle may be selected as a matter of design choice to provide greater or lesser ranges of motion or greater comfort to the user. Furthermore, back supports may be affixed to hip pad 4 in a manner which allows the angle of the back support to be adjusted by the user.

Affixed to one end of the rigid frame 9 is an elastic means 8 the other end of which is detachably attached to the heel of bootie 11. Attached to the other end of the rigid frame 10 is an elastic means 7 the other end of which is attached to the same bootie 11, this one at the toe portion of the bootie. The elastic means may be any form of conventional resistance-type device such as rubberbands or springs.

The elastic means 7 may be adjustably attached to the toe portion of the bootie, such that its position may be relocated along the top of the foot. The reasons for such adjustability will be discussed more fully below.

Figure 2:
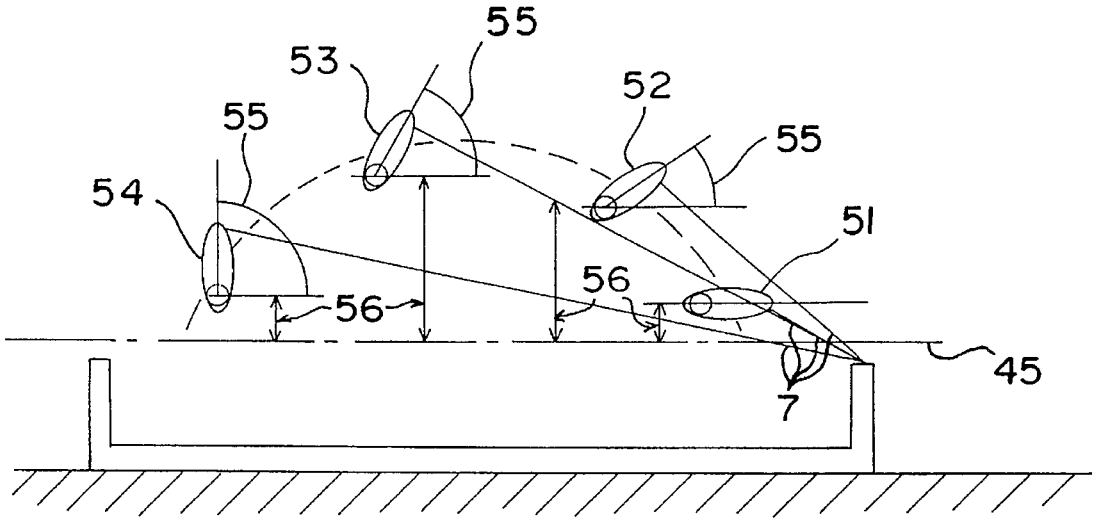
FIG. 2 shows the motion of the leg as viewed from the bottom of the body and the angle of the foot as the exercise motion is performed.
Figure 3:
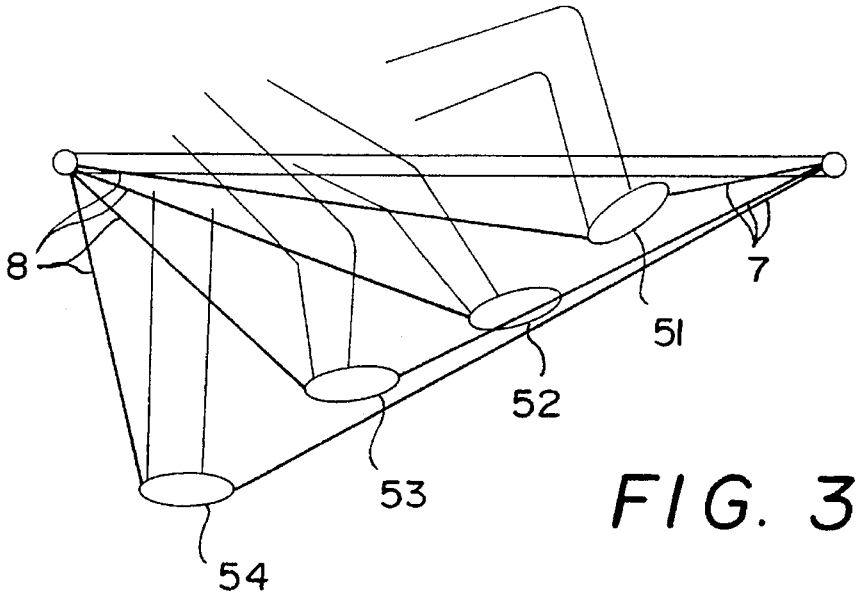
FIG. 3 shows a view of the exercise motion from above.

Referring to FIGS. 2 and 3, the motion of the leg as it goes through the exercise routine begins with the knee drawn up and in front of the body 51 and move to a position behind the body with the leg fully extended 54. As the leg is moved it travels in an arc, beginning and ending near the sagittal plane 45 and reaching its apex above the sagittal plane 53. As the leg draws this arc, the foot is rotated from an orientation parallel to the sagittal plane 45 to an orientation angled acutely from the sagittal plane 54.

As seen in FIG. 2, the motion must include rotation of the foot in order to assure exercise of the lateral rotation of the gluteal muscle. The foot at position 51 is initially parallel to the sagittal plane 45. As the motion progresses to a point indicated by reference numeral 52 the foot angles upward away from the sagittal plane such that angle 55 is greater than zero. As the foot proceeds to a point indicated by reference numeral 53 angle 55 continues to increase until it reaches the end of the motion 54 where angle 55 is at its maximum. At the same time, distance 56 begins at some small value at position 51, increases through motion 52 until it reaches an apex 53 and then decreases until the motion ends at the point indicated by reference numeral 54.

The combination of these movements exercises the rotation and abduction portions of the gluteal muscles range of motion.

Referring to FIGS. 1 and 2, by placing the attachment of the elastic means 7 to the toe of the bootie, additional resistance is provided for the rotation of the foot and leg as it proceeds across the arc thus fully exercising the gluteal muscles. In other words, by placing the resistance point of the elastic means 7 at the toe, the rotational moment of the foot described above encounters a resistance in rotational movement. The elastic means 7 pulls against the rotation of the foot as angle 55 is increased. Thus, the gluteal muscles must provide additional rotational force to turn the foot and is thus more effectively exercised. The position on the foot where the rubberband 7 is attached may be varied along the length of the top of the foot so that resistance can be increased or decreased for the rotational movement as desired.

Referring to FIG. 3, the extension movements of the gluteal muscles are also exercised in the same motion described earlier. As the foot travels from the knee drawn position 51 through intermediate positions 52 and 53 to the leg extended position 54, elastic means 8 resists the straightening of the leg. This creates a squat motion in the leg, exercising the extension component of the gluteal motion.

Similarly, as the leg moves from knee drawn 51 to leg extended 54, the leg moves backwards in the donkey kick motion which is resisted by elastic means 7.

Thus, in the manner described, all three components of gluteal motion may be exercised in one procedure.

The rigid frame 1 may be severed at some point along its length 12 so that the system can be broken down for storage. The frame can be joined and held rigid by means of a locking pin or other conventional locking device 13.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

What is claimed is:

1. A device for exercising the muscles of the leg, comprising:

a rigid frame comprising an elongated bar having a first end and a second end said first and second ends being angled upward;

a hip support intermedially attached to said rigid frame;

a back support removably attached to said hip support;

a bootie having a toe end and a heel end;

a first resistance means connecting the toe end of said bootie to said rigid frame for providing resistance to lateral rotation of the leg; and a second resistance means connecting the heel end of said bootie to said rigid frame for providing resistance to the extension of the leg.

2. A device for exercising the muscles of the leg, comprising:

a rigid frame comprising an elongated bar having a first end and a second end said first and second ends being angled upward;

a hip support intermedially attached to said rigid frame;

a back support removably attached to said hip support;

a bootie having a toe end and a heel end;

a first resistance means connecting the toe end of said bootie to said rigid frame for providing resistance to lateral rotation of the leg, wherein said first resistance means additionally provides resistance to the abduction motion of the leg; and a second resistance means connecting the heel end of said bootie to said rigid frame for providing resistance to the extension of the leg.

3. A device for exercising the muscles of the leg, comprising:

a rigid frame comprising an elongated bar having a first end and a second end said first and second end being angled upward;

a hip support intermedially attached to said rigid frame;

an adjustable back support removably attached to said hip support;

a bootie having a toe end and a heel end;

a first elastic means having a first end and a second end wherein the first end of said first elastic means is detachably affixed to the first end of said rigid frame and the second end of said first elastic means is detachably affixed to the toe end of said bootie;

a second elastic means having a first end and a second end wherein the first end of said second elastic means is detachably affixed to the second end of said rigid frame and the second end of said second elastic means is detachably affixed to the heel end of said bootie.

4. The apparatus in claim 3, wherein said first elastic means provides resistance to the abduction motion of the leg.

5. Apparatus of claim 3, wherein said first elastic means provides resistance to the lateral rotation of the leg.

6. The apparatus of claim 3, wherein said second elastic means provides resistance to the extension of the leg.

7. The apparatus of claim 3, whereby said rigid frame comprises a plurality of segments which are detachably affixed to each other.

* * * * *